US010293382B2

(12) United States Patent
Timoney et al.

(10) Patent No.: US 10,293,382 B2
(45) Date of Patent: May 21, 2019

(54) PLANT TRIMMING SHEAR CLEANER AND SHARPENER

(71) Applicant: Clean Scissors LLC, Grass Valley, CA (US)

(72) Inventors: David Timoney, Grass Valley, CA (US); Jonathan Timoney, Grass Valley, CA (US); Robert R Tupper, The Dalles, OR (US)

( * ) Notice: Subject to any disclaimer, the term of this patent is extended or adjusted under 35 U.S.C. 154(b) by 0 days.

(21) Appl. No.: 16/012,493

(22) Filed: Jun. 19, 2018

(65) Prior Publication Data

US 2019/0009307 A1 Jan. 10, 2019

Related U.S. Application Data

(60) Provisional application No. 62/530,461, filed on Jul. 10, 2017.

(51) Int. Cl.

| | |
|---|---|
| ***B08B 1/04*** | (2006.01) |
| ***B08B 1/00*** | (2006.01) |
| ***B24B 3/52*** | (2006.01) |

(52) U.S. Cl.

CPC ..... *B08B 1/04* (2013.01); *B08B 1/002* (2013.01); *B24B 3/52* (2013.01)

(58) Field of Classification Search

CPC .. B08B 1/04; B08B 1/00; B08B 1/002; B08B 3/00; B24B 3/52

USPC ..... 15/21.1, 28

See application file for complete search history.

(56) References Cited

U.S. PATENT DOCUMENTS

| | | | | |
|---|---|---|---|---|
| 3,020,978 | A * | 2/1962 | Bocchino | B65G 45/08 137/576 |
| 3,471,887 | A * | 10/1969 | Vercouteren | A47L 15/39 15/72 |
| 3,761,984 | A * | 10/1973 | Hauschild | A47L 21/02 134/199 |
| 4,206,526 | A * | 6/1980 | Bertram | A62C 33/02 15/40 |
| 4,589,158 | A * | 5/1986 | Sheldon | B08B 3/006 134/111 |
| 4,600,444 | A * | 7/1986 | Miner | B08B 9/021 134/10 |
| 5,778,476 | A * | 7/1998 | Squillaci | A46B 3/18 15/167.1 |
| 6,145,147 | A * | 11/2000 | Frecska | B08B 1/04 15/77 |
| 7,200,891 | B1 | 4/2007 | McCulloch et al. | |
| 9,247,860 | B2 | 2/2016 | Albright | |

(Continued)

*Primary Examiner* — Christopher R Harmon

(57) ABSTRACT

The invention is a convenient and portable device for cleaning and sharpening cutting tools for gardening such as pruners, clippers, snips, or shears when these have become fouled from working on plants which exude gummy residue or sticky sap when cut. The device includes a reservoir for holding cleaning solutions, at least one motor driving a planetary or epicyclic gearing or slippable roller drive mechanism, to rotate at least one disc so that bristles of the disc process along roulette paths which include a hypocycloid, an epicycloid, a hypotrochoid, or an epitrochoid.

A motor switch detects the insertion of a gardening cutting tool and turns on the motor after a predetermined delay and for a predetermined duration. The cutting tool must be removed for the switch to be reset. The cleaning machine can be powered by internal batteries or external power.

19 Claims, 11 Drawing Sheets

(56) References Cited

U.S. PATENT DOCUMENTS

| | | | | |
|---|---|---|---|---|
| 2002/0100131 | A1* | 8/2002 | Lerner | B08B 1/04 15/77 |
| 2005/0097690 | A1* | 5/2005 | Kaiser | B08B 1/00 15/104.92 |
| 2005/0273957 | A1 | 12/2005 | Boltryk | |
| 2008/0032605 | A1 | 2/2008 | Chan | |
| 2008/0189870 | A1* | 8/2008 | Dayton | A01O 5/02 7/167 |
| 2012/0067369 | A1* | 3/2012 | Currell | B08B 1/002 134/6 |
| 2015/0208605 | A1* | 7/2015 | Dole | A01J 7/04 119/664 |
| 2017/0282232 | A1* | 10/2017 | Goudis | B21C 43/04 |

* cited by examiner

PLANT TRIMMING SHEAR CLEANER AND SHARPENER

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

PRIORITY: CROSS-REFERENCE TO THE RELATED APPLICATION

This non-provisional utility patent application claims the benefit of and priority to U.S. Provisional Application 62/530,461 "Plant Trimming Shear Cleaner and Sharpener," filed Jul. 10, 2017.

The entire content of U.S. Provisional Application 62/530,461 "Plant Trimming Shear Cleaner and Sharpener," filed Jul. 10, 2017, is hereby incorporated into this application document by reference.

FIELD

The invention relates generally to a plant trimming shear cleaner and sharpener.

BACKGROUND OF THE INVENTION

Many types of plants have thick, viscous, or gummy sap or resin in their stalks and other parts, and when trimming, pruning, or harvesting, the shearing or cutting tools used often accumulate sticky residues which can in turn pick up other foreign matter such as dust, fines, or clippings. Over time the tool becomes increasingly difficult to use or to control safely, halting the work while the tool is cleaned. Currently there are a number of methods used to attempt to clean off sticky residue from shears, pruners, or gardening scissors. One of set of methods involves soaking a fouled tool or at least the cutting blades or edges of the tool in a cleaning solution, or oil impregnated sand, or other sorts and mixtures of solvents or abrasives, but these methods fail to satisfy market needs because of how long the trimmers need to be soaked or cycled within the cleaning medium, and the additional steps required to remove gritty abrasive cleaners before returning the tool to service.

Attempts to sharpen gummed up plant trimming shears are often inadequate because although sharpening may remove gummy residue and foreign matter from the immediate area of the tool's cutting surfaces, the rest of the tool will remain substantially fouled. Worse, gummy residues transferred to the sharpening tool will impede subsequent sharpening attempts. Eventually both the cutting tools and the sharpening tools alike will still need to be cleaned.

Working on resinous plants with cutting or pruning tools requires more frequent instances of cleaning and sharpening the tools, and it is often attempted to devise portable cleaning and sharpening tools which can be worn by a gardener or field worker or kept close by a site where pruning, cutting, or harvesting is in progress.

BRIEF SUMMARY OF THE INVENTION

From the aforementioned background it is understood that many objectives exist for a device for cleaning pruners, clippers, shears, or other gardening or harvesting tools used with plants that exude any sort of viscous, sticky saps or resins likely to gum up the mechanical workings of such a cutting tool.

Thus, a primary objective of the invention is to provide an apparatus that scrubs plant trimming shears. A corollary objective of the invention is to provide motive power to moving parts of scrubbing and blade cleaning components and mechanisms of the invention. A further objective of the invention is to provide energy storage within the device for driving the cleaning mechanisms while at work away from conventional power sources. A yet further objective of the invention is to provide for replenishment of energy storage units housed within the device.

Another objective of the invention is to present a cleaning solution or solvent to fouled portions of the tool or at least the cutting surfaces thereof. A corollary objective of the invention is to separate unwanted, gummy residue from cutting surfaces and mechanisms of the cutting tool, by mechanical actions or chemical actions or both. Another corollary objective of the invention is to sharpen the cutting surfaces or dress the edges of the tool, so that if the tool must be taken away from its work, the benefits of both cleaning and sharpening can be gained during a single maintenance task.

Another objective of the invention is to provide means for the cleaning and sharpening apparatus to be kept nearby and ready to clean a tool, such as being able to clip onto a user's garment or belt while trimming plants.

Another objective of the invention is to reduce or prevent loss or spillage of cleaning solution retained in a reservoir within the tool cleaning device. A corollary objective of the invention is to close admittance to or egress from the reservoir when the device is not in use.

Another objective of the invention is to protect the user from contact with any mechanisms or components of the device which may present an opportunity for injury or damage such as pinching hazards, exposed surfaces or edges of sharpening tools especially while in motion, or powered reciprocating or rotating machinery that may catch and wind up clothing or other foreign objects.

Various devices are currently available which attempt to address these challenges, although they may at best meet only one or two aspects of the totality of the requirements.

BRIEF DESCRIPTION OF THE DRAWINGS

A further understanding of the nature and advantages of particular embodiments may be realized by reference to the remaining portions of the specification and the drawings. Similar reference numerals are used to refer to similar components.

DETAILED DESCRIPTION OF THE INVENTION

Figure 1:
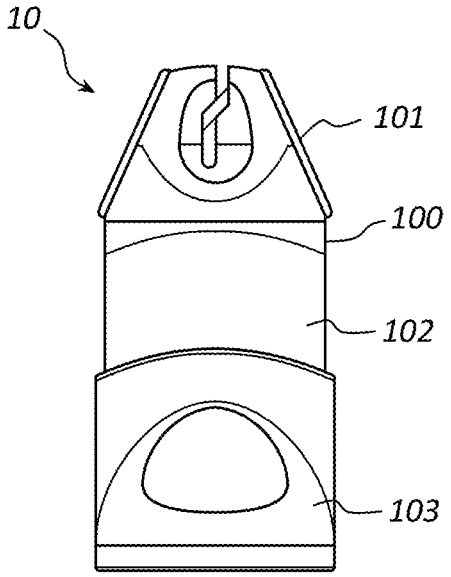
FIG. 1 shows a rear view of an embodiment in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this specification, the term "means for . . . " as used herein including the claims, is to be interpreted according to 35 USC 112 paragraph 6.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered nonexclusive. Also, terms such as "element" or "component" encompass both elements and components comprising one unit and elements and components that comprise more than one unit, unless specifically stated otherwise.

In this specification any singular grammatical gender may subsume any other singular grammatical gender in all cases, and any plural grammatical gender may subsume any other plural grammatical gender in all cases. A user of the invention may be of any biological sex, thus all instances where "he," "his," or "him" are written may be replaced by "she," or "her," as appropriate, to equivalent meaning, effects, intents, and purposes. Also, grammatically irregular plural forms are recognized as their plain language equivalents, so that terms such as "at least one foot" are understood to be equivalent to "both feet" and other similar phrases of equivalent meaning.

"Pruner" in this specification includes any and all manner of hand-operated gardening tools designed to cut plant parts such as stems, leaves, stalks, twigs, and branches and the like, mostly by means of bringing together two slightly offset blades to rupture the material being cut by shearing stress overcoming the material strength. "Pruners" in this specification also include scissors, shears, clippers, and other similar hand operated devices having at least two handles or levers connected by a pin so that a grasping hand can pinch and sever plant matter by means of the tool's cutting blades operating at a mechanical advantage which multiplies the user's grasping or clenching force.

Some plants exude gummy sap or other highly viscous or sticky fluids which transfer to a cutting tool during pruning, harvesting, or maintenance performed on plants. The gummed-up tool is harder to operate safely and effectively. In one class of embodiments, the invention is a pruner cleaner available in several embodiments, some being portable on the person for workers doing landscaping, harvesting, or pruning chores, and other being designed for use at a workbench or table where a person can clean batches of fouled tools and return them into service. A portable embodiment can include a clip or attachment for hanging the pruner cleaning tool from a person's belt. The clip or attachment itself also be detachable from the unit.

The apparatus fulfills the need for a shear soaking and cleaning device. The invention is reusable. Among other things, it is an advantage of the invention to provide a plant trimming shear cleaner and sharpener that does not suffer from any of the problems or deficiencies associated with prior solutions. In another class of embodiments, the invention advantageously sharpens the shears while they are being cleaned. Some embodiments include a battery operated motor. A best mode motor is a motor controlled by a pulse width modulator, because this means of motor control retains high torque at low speeds.

Figure 2:
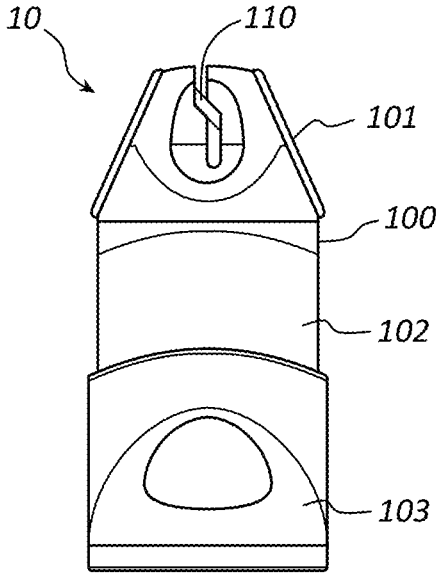
FIG. 2 shows a front view of an embodiment in accordance with the invention.

Referring to the figures, FIGS. 1 through 9 show a particular embodiment of the shear cleaning device, also referred to as a pruner cleaning machine. FIG. 1 shows a front view of the pruner cleaning machine [10] which is generally comprised of a container [100] adapted with three portions; a cap portion [101,] a body portion [102,] and a base portion [103] assembled in a stacked configuration and adapted for cleaning a pair of shears [1 in FIG. 6,] either by manual scrubbing or powered cleaning. FIG. 2 shows a rear view of an embodiment of the invention wherein the body portion [102] of the container [100] is adapted to receive a volume of cleaning solution for soaking and aiding in the cleaning of a pair of shears or pruners introduced into the container. The cap portion [101] of the pruner cleaning machine [10] is generally provided to seal the container [100] and secure the shears or pruners being cleaned within the pruner cleaner machine. The cap portion [101] also includes a blade sharpener [110] for the shears and includes an aperture allowing for the addition of cleaning solution.

Figure 3:
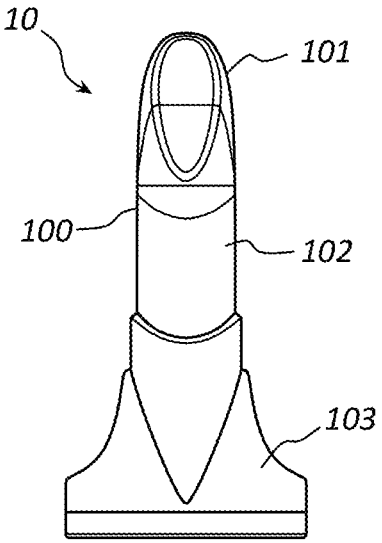
FIG. 3 shows a left side view of an embodiment in accordance with the invention.
Figure 4:
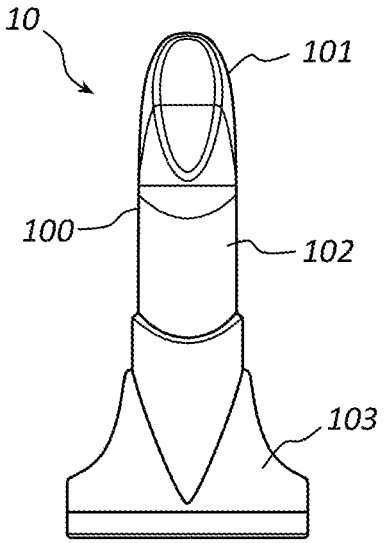
FIG. 4 shows a right side view of an embodiment in accordance with the invention.

FIGS. 3 and 4 show left-side and right-side views of an embodiment in accordance with the invention, including a cap portion [101,] body portion [102,] and base portion [103] of a pruner cleaning machine [10] as previously described.

Figure 5:
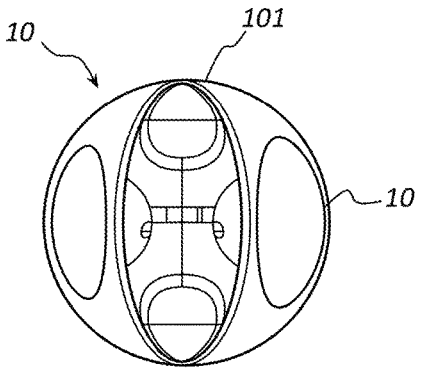
FIG. 5 shows a top view of an embodiment in accordance with the invention.

FIG. 5 shows a top view of an embodiment in accordance with the invention, wherein a cap portion [101] and base portion [103] of a pruner cleaning machine [10] are visible from this viewpoint.

Figure 6:
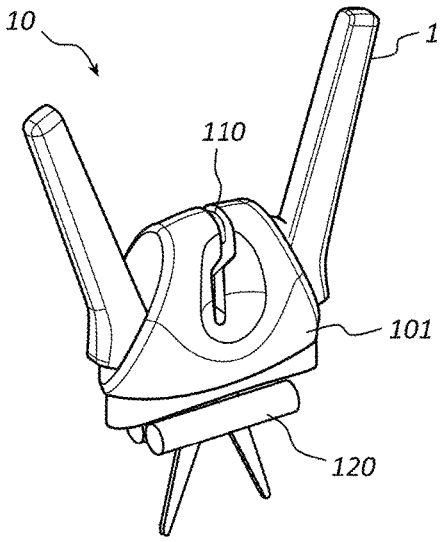
FIG. 6 shows a cutting tool received into a cleaning compartment in accordance with the invention, with blade cleaners of the invention engaged with a portion of the blades of said cutting tool. Other components of the invention are omitted for clarity.
Figure 7:
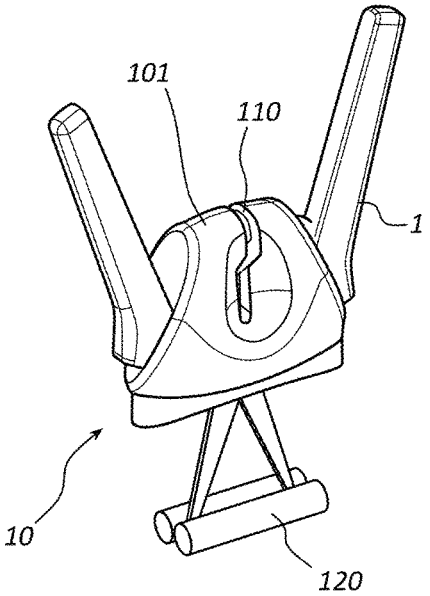
FIG. 7 shows a cutting tool received into a cleaning compartment in accordance with the invention, with blade cleaners of the invention engaged with an alternate portion of the blades of said cutting tool. Other components of the invention are omitted for clarity.

FIGS. 6 and 7 show a portion of the components of an embodiment in accordance with the invention, and also a pruner [1] inserted into the pruner cleaning machine [10.] The cap portion [101] includes a blade sharpener [110.] the container and base are omitted in these views to reveal cleaning rollers [120] which are designed to rotate while traversing up and down the pruner blades to be cleaned. Downward excursion immerses the rollers in cleaning solution so that the solution is applied to the blades in the context of rolling and sliding actions which comprise a scrubbing action by the cleaning rollers upon the blades. In a preferred embodiment, at least one blade cleaner is detachable.

FIG. 6 shows a pruner cleaning machine [10] cleaning a pruner [1] by cleaning rollers [120] at or near the end of an upward excursion or stroke, and FIG. 7 shows the cleaning rollers [120] at or near the end of a downward excursion or stroke. Both FIGS. 6 and 7 also show the cap portion [101] and its blade sharpener [110.]

Figure 8:
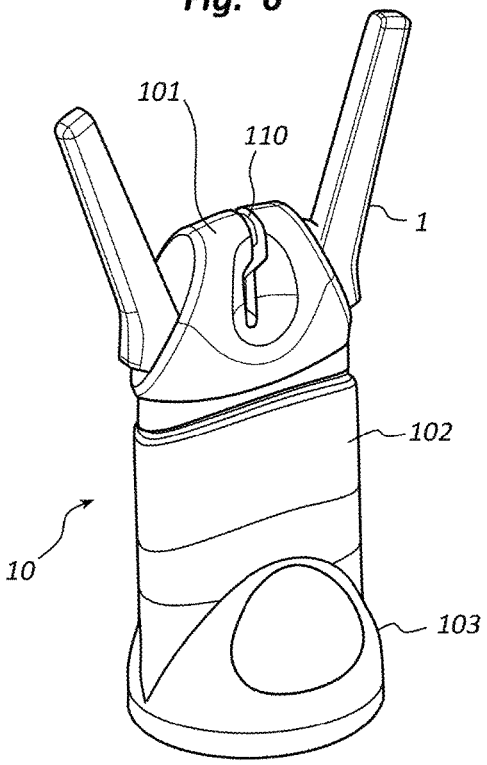
FIG. 8 shows an oblique view of a device in accordance with the invention, with a tool to be cleaned received within the device.

FIG. 8 shows an oblique view of a pruner cleaning machine [10] with a pruner [1] received into its cap portion [101.] The body portion [102] and base portion [103] are also visible. The base portion is adapted to include a motor in communication with the cleaning rollers, and the base portion [103] may include a power source to power the motor and generally manipulate the rollers [120] in a rotational and vertical movement to scrub the shears [1] within the pruner cleaning machine [10.] In other embodiments in accordance with the invention, the rollers may be powered or driven manually. The base portion [103] can be substituted with a belt clip allowing for attachment of the pruner cleaning machine to a belt of the user. Also, the pruner cleaning machine can be used in various positions, including being placed in a locked position with the blade sharpener [110] in the cap [101] being powered or manually operated. The blade sharpener preferably comprises a material effective for abrading cutting blades and especially those made of tempered steel or high-carbon steel or other alloys selected for toughness and for being able to take and keep an edge for cutting. Typical materials for sharpening and honing include ceramic, chert, flint, bonded abrasives, quartz, silicon carbide, carborundum, aluminum oxide, corundum, sedimentary stone, rottenstone, tripoli, carbon steel alloy, diamond coated steel, diamond plate, and diamond grit.

Figure 9:
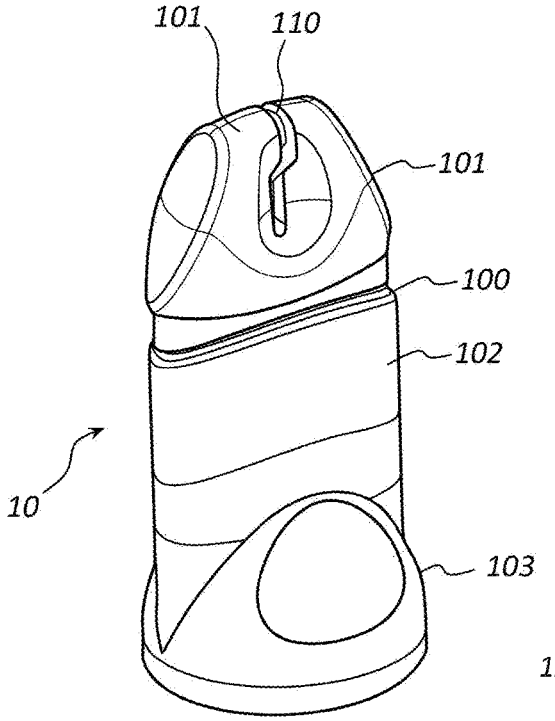
FIG. 9 shows an oblique view of an embodiment in accordance with the invention.

FIG. 9 shows an oblique view of the foregoing embodiment of a pruner cleaning machine [10,] having a blade sharpener [110] in a cap [101] with a container [100] for retaining a cleaning solution, a body portion [102,] and a base portion [103] assembled in a stacked configuration and adapted for cleaning a pruner received into an aperture in the cap.

In summary, the foregoing embodiment is a pruner cleaning machine comprising a base, which houses a motor and a switch, at least one blade cleaner coupled to the motor, a cleaning solution reservoir detachable from the base, and a cleaning compartment slideably coupled to and slideably received into the cleaning solution reservoir, with the cleaning compartment further comprising at least one orifice and at least one moveable cap to cover or close such an orifice.

The pruner cleaning machine can also house at least one battery, which can be a disposable or a rechargeable battery. The pruner cleaning machine can further comprise locking means wherein the cleaning compartment may be locked into the cleaning solution reservoir.

A blade cleaner for the pruner cleaning machine can be a roller, a brush, or a pad, and the blade cleaner can be made of cancellous or elastomeric material. The moveable cap of the pruner cleaning machine can also comprise an elastomer. In this specification, an "elastomer" includes materials such as natural and synthetic rubbers, EPDM, TPR, buna-n, Perbunan, acrylonitrile butadiene rubber, and other butyl and nitrile materials.

The cleaning compartment of the pruner cleaning machine can also include locking means to receive a pruning tool and retain said pruning tool in a retention position wherein blades of said pruning tool displace said movable caps and are admitted into said cleaning compartment. Locking means can include a force-fit or interference fit of the pruner into a rubber well shaped to closely conform to the pruner at its insertion depth into the machine, or an adapter may be provided with a common exterior contour and an interior contour adapted to closely fit to and retain the pruner. Because many different designs of pruners exist, a set of adapters can be made to accept any particular brand, make, or model within its interior contour while the exterior contour is a singular design to best mate with the flexible portion of the cap.

The cap is designed to retain a pruner in rigid or preferable flexible engagement of the pruner blades with the blade cleaners in motion within the pruner cleaning machine. Sliding the cleaning compartment into said cleaning solution reservoir while a pruning tool is retained in a retention position immerses at least a portion of at least one of said blades into a cleaning solution. During this excursion, it is preferred that at least one blade cleaner gets dipped into cleaning solution retained within the cleaning solution reservoir, and also preferred that sliding the cleaning compartment into the cleaning solution reservoir while a pruning tool is retained in a retention position in the cap also causes at least one blade cleaner to contact a blade and to translate along a surface of a blade. The motor rotates at least one blade cleaner. In a more preferred embodiment, 40-60% of the area of the scrubbing face of a scrubber disc is immersed in cleaning solution during the course of excursion of the discs while a planetary shaft makes a complete revolution within the epicyclic mechanism.

A corollary embodiment in accordance with the invention is designed so that sliding the cleaning compartment into the cleaning solution reservoir while a pruning tool is retained by the cap in a retention position closes a power switch configured to energize the motor. A "switch" in this specification can also be a sensor capable of detecting the proximity or presence or absence of a pruner inserted into the cap of the invention, thus a "switch" can also include a magnetic sensor, a Hall effect sensor, or a reed switch or a wand connected to a momentary contact mechanism so that displacement of the wand or the reed by the presence of a pruner received in an aperture in the cap of the machine closes an electrical circuit or sends an electrical signal to a circuit. The switch can be a proximity switch.

A "switch" can of course also mean a manually operated switch such as a toggle, rocker, or pushbutton switch. However, these types of switches may be less preferred because the motor can waste energy if left running even while a pruner is not present within the invention with its blades to be cleaned. Also, using a manually operated switch permits pruners to be inserted for cleaning for arbitrary durations of time. Using electronic sensors to switch the motors on and off can include more sophisticated or more egalitarian criteria, so that each pruner to be cleaned receives a timed scrubbing, or that cleaning proceeds until the applied torque generated by the motor falls below a predetermined value indicating that enough gummy material has been removed from the pruner for it to be deemed fit for service. Using this shutoff criterion would conserve energy by scrubbing more heavily gummed up blades for a longer period of time. Bypassing a user decision of how long to clean each particular pruner might also obviate subconscious implicit biases based on irrelevant factors or user inexperience with how long the cleaning machine takes to clean a particular set of pruners.

Thus, although the motor control circuitry is designed to switch on the motor and scrubbing mechanism only after a pruner is received into an aperture in the cap and into the housing, the word "after" as used in this specification can mean any predetermined delay, and can even include the nearly infinitesimally small delay for electrical energy to propagate from a switch connected directly to a motor. The switch to turn on the motor resides within a housing and is configured to energize the motor after a pruner is received into the reservoir, or alternatively, after a predetermined delay following the insertion of a pruner into an aperture in the cap.

In addition to a proximity switch, the invention may include a timing circuit whereby the motor is energized after a predetermined delay following insertion of a pruner into said aperture has elapsed. The timing circuit can energize the motor for a predetermined duration following insertion of a pruner into said aperture. After the duration has elapsed, the timing circuit de-energizes the motor. Also, to discourage overuse of the motor after a sufficient cleaning operation has elapsed, a reset circuit can be included in the motor control circuitry so that a de-energized motor remains de-energized until the inserted pruner, which has been cleaned once already, is at least partially extracted from said aperture. The user can inspect the results and begin an additional cleaning cycle if necessary, but the motor will stop after a while in the event that a user inserts a pruner to be cleaned and then leaves the machine unattended.

Another embodiment of the invention includes that the pruner cleaning machine has a base with at least one attachment site so that a base of another pruner cleaning machine can be coupled to it at said attachment site.

Figure 10:
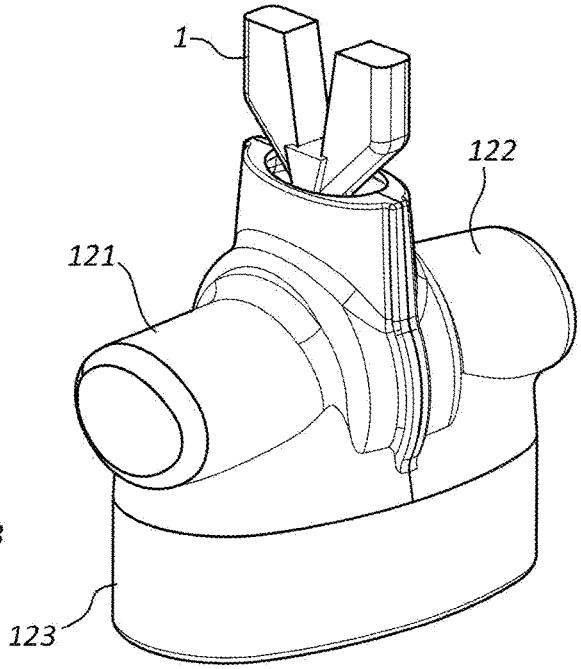
FIG. 10 shows oblique view of an alternative embodiment in accordance with the invention.

FIGS. 10 through 22 describe yet further embodiments in accordance with the invention and these shall be described in detail. FIG. 10 shows a twin-motor embodiment of the invention with pruners [1] to be cleaned inserted into a pruner receiving aperture in its cap. The invention is a pruner cleaning machine which in the embodiment shown has two symmetrical housings [121] and [122] which adjoin at a plane of symmetry to form a reservoir beneath the blades of the pruner and beneath the cap. Both housings sit atop a base [123] which is a tray containing one or more batteries and one or more printed circuit assemblies.

Figure 11:
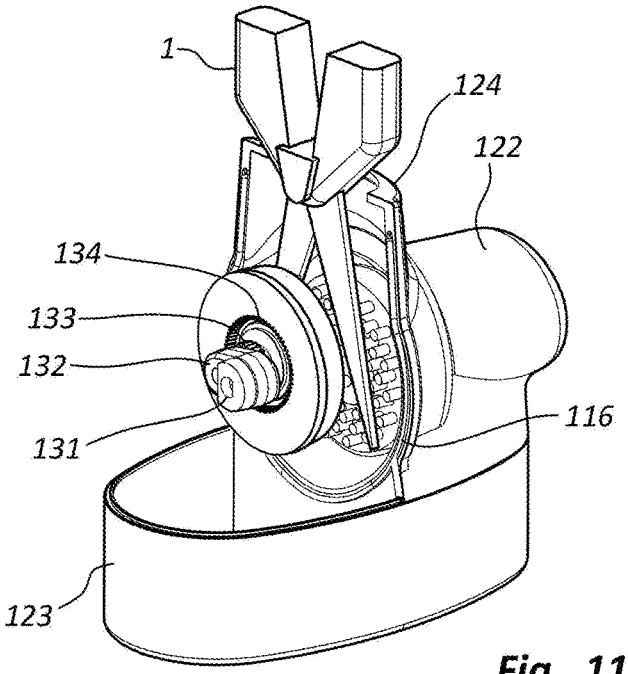
FIG. 11 another view of an alternative embodiment of the invention, with one portion of a housing removed to exposes some of the internal mechanisms.

FIG. 11 shows this embodiment with the left-side housing, motor, and motor mount plate omitted. The motor used in this embodiment includes a right-angle reduction gearbox so that its output shaft is perpendicular to its rotor. The lugs to which electric wires are connected reside in the base [123] of the invention.

The motor output shaft is operably coupled to and drives a carrier [131] which carries a planetary shaft [132] rotatably coupled to it and radially offset from the axis of the output shaft of the motor. Thus the planetary shaft is operably coupled to the motor. The planetary shaft in this embodiment carries a toothed gear [133] mounted thereon, which is meshed to and rides within a stationary internally toothed gear which is also called an annular gear [134.] The two gears comprise what is also called an epicyclic gear train, and a carrier in a planetary or epicyclic gear train is also called a differential arm.

The cap [124] of the invention is shown here cut as a section view to expose the other components discussed, and the external housing [122] of the right-side portion of the invention is also shown. A seal [116] is interposed between the left and right housings to form a fluid-tight basin or reservoir for cleaning solution. A seal can be an o-ring, a gasket, or any elastomeric material compressed between a left housing and a right housing. A seal can have a closed contour or an open contour. A pruner [1] is shown received into the cap.

Figure 12:
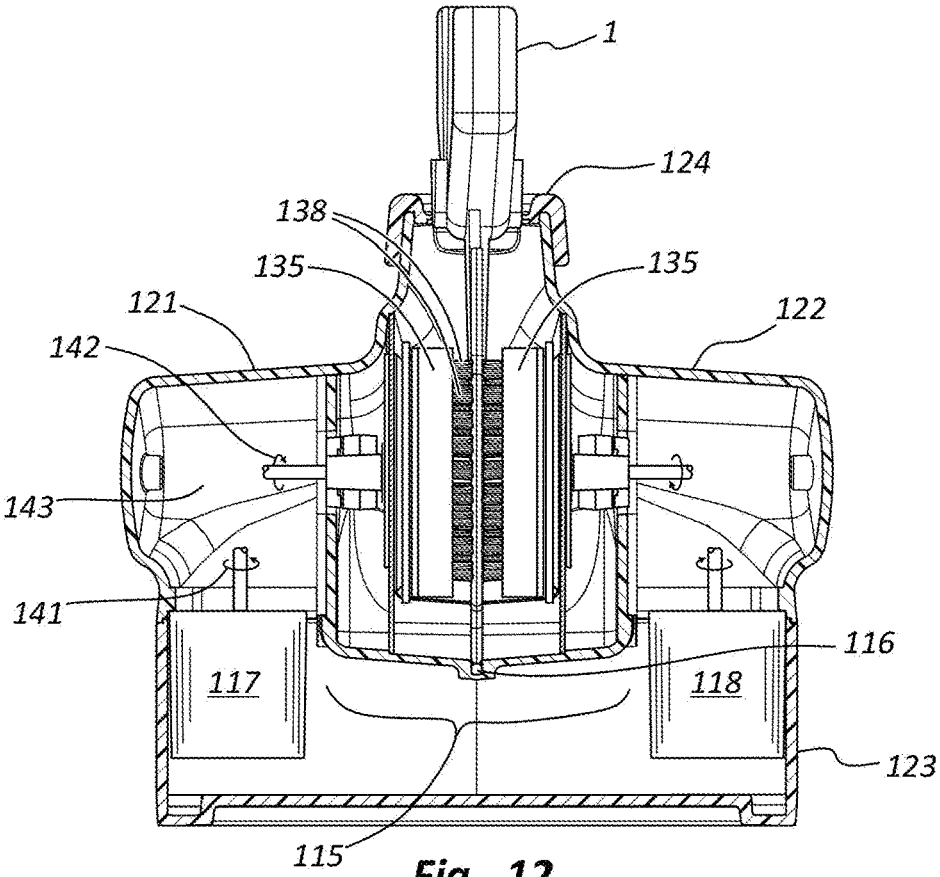
FIG. 12 shows a cross-section view of an alternative embodiment of the invention.

FIG. 12 shows another cut-away view of the invention with some components sectioned to expose internal components to be discussed. The pruner cleaning machine [20] according to the embodiment shown comprises left [121] and right [122] housings joined beneath a cap [124] which closely conforms to the pruner [1] to be cleaned. This twin-motor embodiment has a first motor [117] and a second motor [118.] Each motor has a shaft [141] which is operably coupled to a carrier of an epicyclic gear train by means of a right-angle gearbox [143] having its output shaft [142] perpendicular to the rotor of the motor. The right-angle gearbox is preferred when a motor runs at high speed and low torque and the gearbox is a reduction gearbox exchanging speed for increased torque. Another embodiment may use a motor rotating on an axis substantially parallel to the rotational axis of the carrier arm, with reduction gearing between the motor and carrier arm. An alternative embodiment using a direct-drive motor connected directly to the carrier or a reduction gearbox having an output shaft emerging in some other direction is also within the scope of the invention. Thus the first motor can be disposed within the left housing and the second motor disposed within the right housing. In any such embodiment, a reduction gear is operably coupled between a motor and a cleaning disc of the invention and the motor is of course, operably coupled through a planetary transmission to a cleaning disc.

Internal features of the left and right housings come together to form a reservoir section [115] beneath the cap and a pruner received into the cap. The reservoir retains a liquid cleaner selected or created as a solvent for softening and dissolving plant sap, gum, and other sticky stuff which has accumulated onto the pruner and its blades sufficient to impair its use in the field. A seal [116] or gasket disposed between the left and right housings confines the liquid to the reservoir formed between the left and right housings, and prevents its leakage into the volume of the base [123] below. Electronics and batteries are housed within this volume, and it is important to prevent the solvent cleaner from contaminating and possibly corroding these components.

Each of the rotatable planetary shafts of both epicyclic gear trains mount a movable cleaning disc [135.] A first cleaning disc is disposed within the left housing and a second cleaning disc is disposed within the right housing. The discs rotate with their planetary shafts, and the center of rotation of each disc follows a circular path as the spur gear rides within the annular gear of the epicyclic mechanism. When the reservoir is adequately filled with cleaning solution, the circular path of the center of rotation of the disc dips each disc into the solution during at least some portion of its path, and there will always some point on a perimeter of the disc that enters into the reservoir and the cleaning solution therein. The surface of the cleaning disc facing the blades to be cleaned can have a sponge, an abrasive coating, an abrasive or cancellous material, or in a best mode, bristles [138] which can be uniformly dispersed or grouped into tufts which emerge from the body of the disc. When spinning, a portion of a disc or its bristles which dip into the cleaning solution at speed will pick up the solution and fling it off by centripetal force so as to asperse all surfaces of the pruner which are received within the invention. It is desirable that an aperture in the cap of the invention conform closely to the pruner so as to prevent cleaning solution from being sprayed outside the machine. It is therefore also preferred to use a pruner sensing mechanism or a sensor or circuit as a switch to keep the motor of the machine unpowered if a pruner is not present to plug the aperture in the cap of the machine. The switch resides within the housing and energizes a motor after a pruner is received into an aperture in the housing or the cap.

Figure 13:
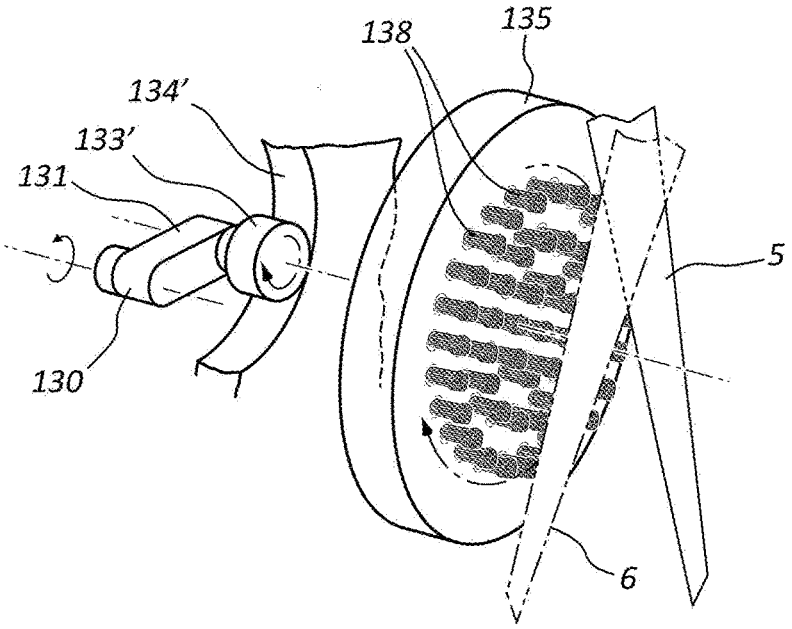
FIG. 13 shows an embodiment of the invention which has a planetary shaft in contact with an annular gear or internal cylindrical surface.

FIG. 13 helps illustrate the roulette path taken by bristles [138] on a cleaning disc [135] driven by an epicyclic drive in accordance with the invention. Because the discs are driven on an epicycle, there is at least one point on the perimeter of a cleaning disc which moves in a roulette path. A cleaning disc is also called a scrubber disc in this specification.

A roulette is generally defined as a curve described by a point (called the generator or pole) attached to a first given curve, as that curve rolls without slipping along a second given curve that is fixed. More precisely, given a curve attached to a plane which is moving so that the curve rolls without slipping along a given curve attached to a fixed plane occupying the same space, then a point attached to the moving plane describes a curve in the fixed plane and this curve is called a roulette.

Many roulette curves are formed from the motion of a simple circle or ellipse rolling inside or outside another simple closed curve. A hypocycloid is a plane curve generated by the trace of a fixed point on a small circle that rolls within a larger, fixed circle. An epicycloid is a plane curve produced by tracing the path of a point on the circumference of a circle which rolls without slipping around a fixed circle. An epicycloid is also called a hypercycloid. A hypotrochoid is a roulette traced by a point outside of and attached to a small circle rolling around the inside of a larger fixed circle. An epitrochoid is roulette traced by a point inside of and attached to a small circle rolling around the inside of a larger fixed circle. A limacon is a special case of epitrochoid formed by the path of a point fixed to a circle when that circle rolls around the outside of a circle of equal radius. A cardioid is a special case of limacon formed when the generating point resides on the perimeter of the rolling circle. A nephroid is an epitrochoid formed by the path of a point on a diameter of a circle of radius r rolled about the outside of a fixed circle of radius 2*r*. In an epicyclic gear system, both the first and second curves are most commonly circles, although for special cases, an epicyclic gear train can drive a point on an elliptical path.

Returning to FIG. 13, the carrier [131] rotated about an axis of rotation [130.] Although in a preferred embodiment the planetary gear rotatably mounted on the carrier is a toothed gear with external teeth riding within an annular gear, it is also within the scope of the invention to have a carrier with a planetary shaft rotatably coupled to it which has a roller [133'] mounted on the planetary shaft. In such an alternative embodiment the planetary shaft includes a roller having a friction surface without teeth that impinges upon a cylindrical friction surface [134'] also without teeth. The roller is in contact with the cylindrical surface. The materials and durometer of the friction surfaces are selected to substantially eliminate slipping. However, in the event that the cleaning disc is suddenly halted by a foreign object in the cleaning chamber, or the torsional demand of the discs overloads the transmission mechanism, or some other mechanical malfunction occurs to halt the disc, the friction surfaces can slip to relieve the motor of an overload torque.

Building in a mechanical 'fuse' between the motor and the cleaning discs can prevent damage to the motor and provide a safety disengage in the event of an accident. One class of accident mitigated by slippable rollers as a mechanical 'fuse' is if foreign matter such as a vine or tendril, or part of a user's garment such as a drawstring, ribbon, loose cuff or sleeve, or part of a user's hair accidentally enters the cleaning chamber. Such strands of material could get wound up by rotating parts within the pruner cleaning mechanism and precipitate further injury, discomfort, or inconvenience.

Including torque-limiting means operably coupled between the motor and the cleaning disc [135] allows slippage which can mitigate the severity and consequences of foreseeable accidents or malfunctions. Torque limiting couplings for shafts are available in many designs such as disc clutches and other devices usually including a friction surface spring-loaded or mechanically interfering with another friction surface so that slippage occurs when a coefficient of static friction between the friction surfaces is exceeded.

The cylindrical surface [134'] is a stationary surface and can be part of the housing of the invention. The cleaning disc [135] includes brushes or bristles [138] which, as they follow roulette paths, come into intermittent scrubbing contact with the blades of the pruner being cleaned. Since a pruner typically has two blades, the cap of the invention can be designed to present the left blade [5] of the pruner to the left-side cleaning disc and the right blade [6] to the right-side cleaning disc respectively. Blade [6] is shown in phantom in this figure because the left-side cleaning mechanism is omitted from this view. By studying the arrows representing the rotational directions on the axes of the rotary components, it can be appreciated that blade [5] is always pressed upon by downward moving bristles or scrubbing surfaces of its cleaning disc, and similarly, the right blade [6] will be pressed upon by downward moving features of its cleaning disc. Judicious selection of motor output shaft directions and the relative diameters of the gears or slippable rolling surfaces of the epicyclic drive mechanism can establish these downward sliding contacts of the discs onto the pruner so that the pruner experiences a net inward or downward pulling force helping to retain it within the cleaning machine while in operation. The opposite situation should be avoided at all costs, because upward-moving contacts of the discs onto the pruner might serve to eject it from the machine while it is still running.

Figure 14A:
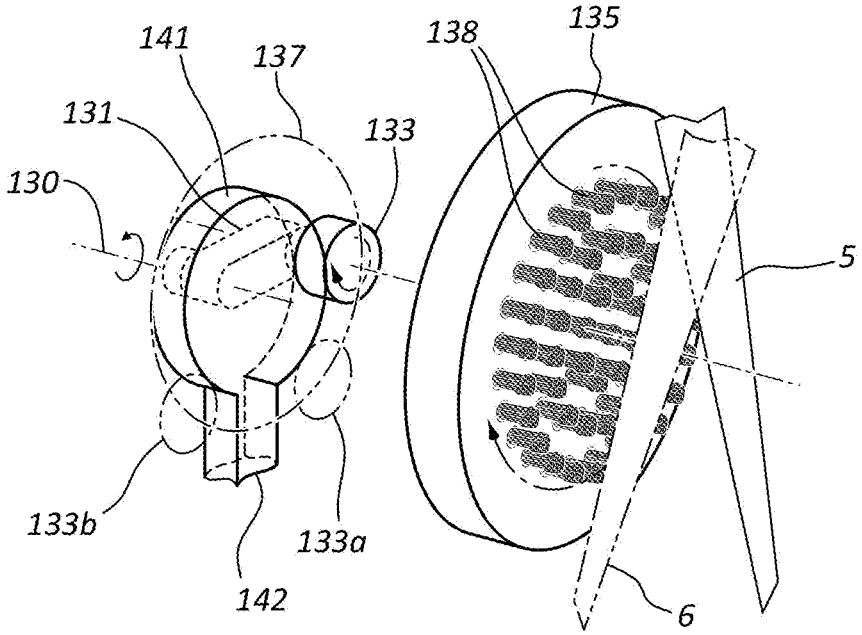
FIG. 14*a* shows an embodiment of the invention which has a planetary shaft in contact with a sun gear or external cylindrical surface.

FIG. 14*a* shows an epicyclic drive which is a sun and planet system. The components described in this figure may be a toothed gear as a planetary meshed to a stationary sun gear, or they may be rolling surfaces coupled by friction but able to slip when torque limiting is desired as explained previously. Carrier [131] rotates about an axis of rotation [130] and planetary component [133] which can be a toothed gear or a roller, rolls without slipping against a stationary sun gear [141] or a cylindrical surface concentric to the axis of rotation of the carrier. Note that it is also possible for a spur gear or toothed wheel, or a roller made of a hard surface embossed with a texture, to roll without slipping against an elastomeric or rubberized surface and gain the benefit of a slippable gear train as explained previously. Similarly, the sun gear or annular gear can have a toothed or textured surface with the planetary having an elastomeric sleeve or a rubber roller, and obtain the same benefits of a slippable drive. The planetary roller or toothed wheel can be a separate component assembled onto or pressed onto the planetary shaft, or it can be an integral feature molded or machined into the planetary shaft.

The scrubber disc [135] with its bristles [138] is coupled to the planetary roller or gear so that both rotate on a common axis of rotation. As in FIG. 13, the left blade [5] of the pruner is always pressed upon by downward moving bristles or scrubbing surfaces of its cleaning disc, and similarly, the right blade [6] of the pruner will be pressed upon by downward moving features of its cleaning disc.

To fix the sun gear in place with respect to the drive motor, some means of attachment [142] must connect it to the housing. This support structure almost inevitably interferes with and prevents a complete, continuous rotation of the planetary shaft about the sun. Therefore the motor in this embodiment would have to have a reciprocating drive that would oscillate the course of the planetary shaft along an arc [137] between extents [133*a*] and [133*b*.] Unfortunately, according to this arrangement the preferred condition of contacting the pruner blades with downward moving scrubbing elements at all times can only obtain during one direction of reciprocating motion. Rotation in the opposite direction presents the pruner blade with upward moving elements and deleteriously creates the opportunity for hazards described above.

Figure 14B:
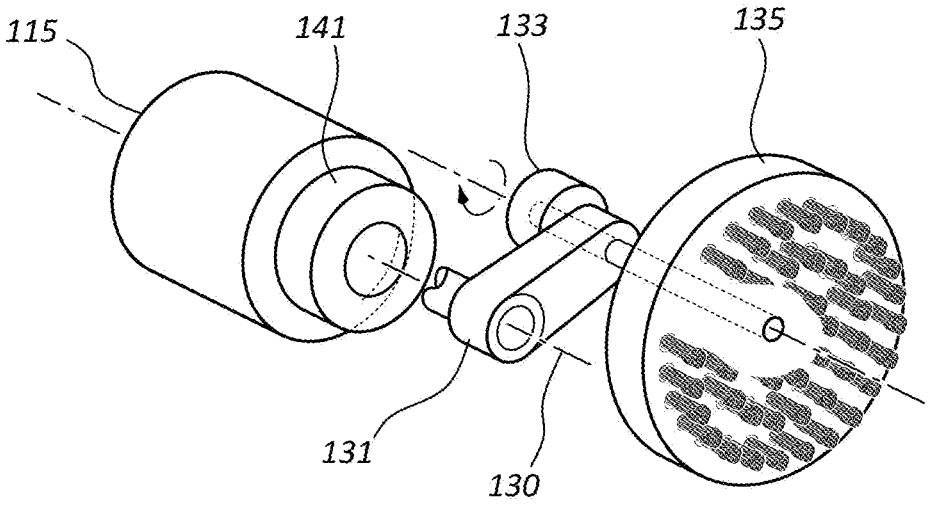
FIG. 14*b* shows an alternative embodiment of the invention in which a planetary shaft rotates in contact with a sun gear or external cylindrical surface mounted on the motor.

FIG. 14*b* shows the epicyclic drive arranged in a preferred embodiment which eliminates the need for external support structure attached to the sun gear that would prevent complete and continuous revolution of the planetary components. With the sun gear [141] mounted onto the face of the motor [115,] (or the output shaft of a gearbox) the carrier [131] rotates about an axis of rotation [130] and holds the planetary gear or roller [133] in contact with the sun. The scrubber disc is mounted on the planetary shaft and rotates with it while the planetary orbits the sun. This mechanism offers continuous rotation and can present continuously downward moving scrubbing elements to the pruner blade. Also, although in the embodiment shown the axis of rotation [130] and the axis of rotation of the scrubber disc are co-planar and parallel, this need not obtain; the axis of rotation of the scrubber may be skew or may converge with the axis of rotation of the carrier at an arbitrary point, so that the rotation of the scrubber may process about the axis of rotation of the carrier.

Figure 15:
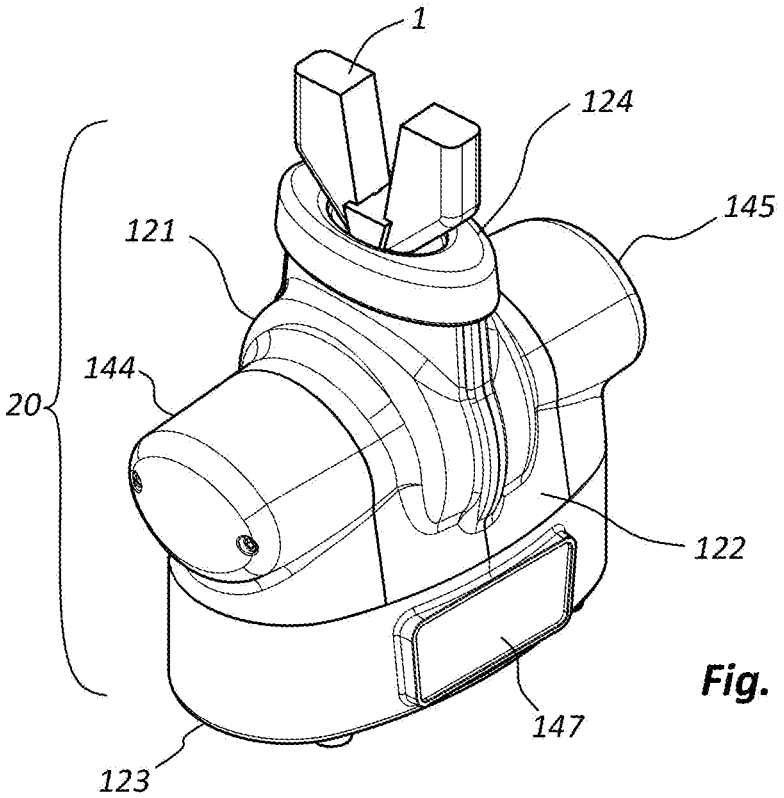
FIG. 15 shows another alternative embodiment in accordance with the invention.

FIG. 15 shows another alternative embodiment in accordance with the invention. The pruner cleaning machine [20] has a left housing [121] and a right housing [122] which are substantially symmetrical and touch each other on a center plane. A cap [124] sits atop the conjoined housings and has an aperture which admits a pruner [1] to be cleaned. Two scrubbing mechanisms are housed, one within each the housing, each driven by a motor residing in a cowl attached to each housing. In this figure a left cowling [144] attaches to the left housing and a right cowling [145] attaches to the right housing. The housings and cowlings all install atop a base [123] which acts as a tray which contains batteries and circuit components. The tray includes a raised, substantially flat area [147] or escutcheon, with a perimeter rim which can include raised, relieved, embossed or indented lettering or indicia for the branding, logos or other indicia. The escutcheon can also be a cylindrical or positively curved surface, and it can also be fashioned to receive a sticker or label displaying indicia.

Figure 16A:
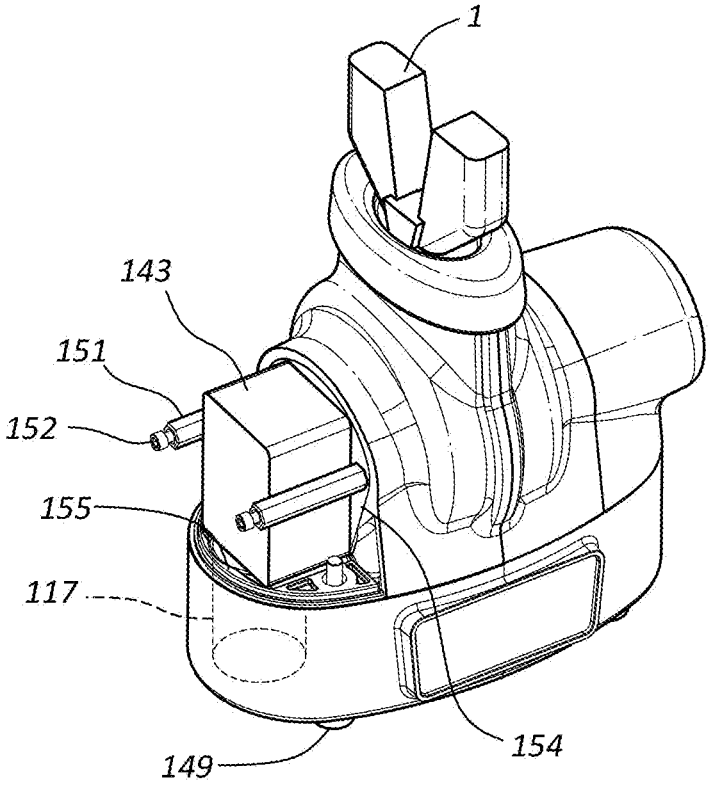
FIGS. 16*a* through 16*d* show the invention with successive parts being removed to expose and explain internal mechanisms, with FIG. 16*d* showing some components of the epicyclic drive, viewed from the right side after the entire right-side components are omitted.

FIG. 16*a* is one of a series of figures in which successive components are omitted from view so that the internal machinery components can be successively exposed and explained. In FIG. 16*a* the left cowling is removed, exposing the right-angle gearbox [143] of the left motor [117.] The cowling is held in place by fasteners [152] which secure it onto two studs [151] which themselves are secured to a motor faceplate [154.] The motor faceplate is also secured to the output shaft face of the right-angle gearbox. The bottom of the right-angle gearbox is secured to a motor mount plate [155.] The cowling also has a downward protruding flange or lip which runs inside the perimeter of the tray, so that when the fasteners [152] and other fasteners extending from beneath the tray are installed, the cowling is firmly retained. The tray can also have feet [149] and especially rubber feet or suction-cup feet to hold the machine in place on a work surface against vibration during its operation.

Figure 16B:
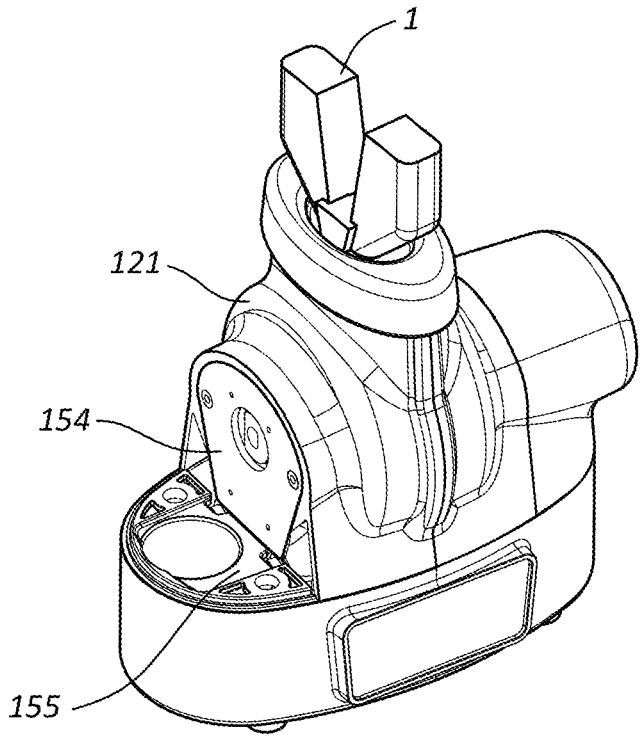

FIG. 16*b* shows the left side of the invention with the studs and right-angle gearbox removed to expose the motor faceplate [154] and the motor mount plate [155.] In a preferred embodiment, the motor faceplate can be insert molded into the left housing [121,] or the left housing can include receiving features complementary to the contour of the motor faceplate so that with the assembly of said faceplate to said housing and with the left cowling and the base (also called a tray) all secured by their fasteners, the motor and gearbox, and the motor mount plate and motor faceplate are all immovably secured within the invention, especially in resisting reaction torques from the scrubber discs moving against and cleaning the blades.

In an embodiment using a direct-drive motor with no right-angle gearbox, such a motor would be secured to the motor faceplate, to the same immovable effect once the housing, cowling and base are securely assembled together.

Figure 16C:
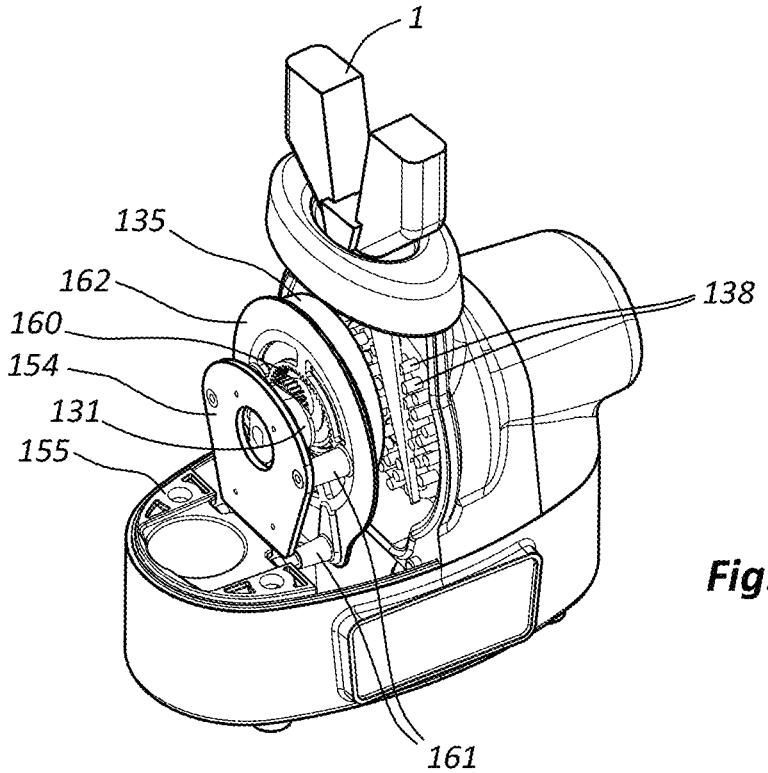

FIG. 16*c* shows more parts of the left-side epicyclic drive of the invention after the left housing has been removed. The motor mount plate [155] and motor faceplate [154] are shown. The carrier [131] carries a planetary shaft with a toothed wheel that rides inside an internal tooth gear or an annular gear [160] which in this embodiment is part of a plastic molding overmolded within an epicycle plate [162] which can be made of sheetmetal but is preferably stainless steel or aluminum for corrosion resistance. Aluminum components can be anodized with a hard coating to resist abrasion from foreign matter. The molded plastic portion of the epicycle plate includes several spacer struts [161] which space apart the epicylcle plate from the motor faceplate so that these two plate parts are substantially parallel and secured to each other. A scrubber disc [135] is secured to the planetary shaft. The bristles [138] of this left-side scrubber disc can scrub the left sides of both blades of the pruner received into this pruner cleaning machine, and according to a preferred variation they can be long enough to also clean portions of the edges of the blade and some other surfaces of the pruner blades as well.

In an alternative embodiment, the epicycle plate receives a first overmolding or insert molding operation to form the annular gear feature and the spacer struts and affix these to the epicycle plate, and then this overmolded part is then inserted into a mold tool of a second overmolding operation which forms the housing of that side of the invention. In such an embodiment, the epicycle plate, the annular gear (or internal cylindrical surface if a slippable roller epicyclic drive is used,) and the housing of that side of the invention are united into a single physical component.

Figure 16D:
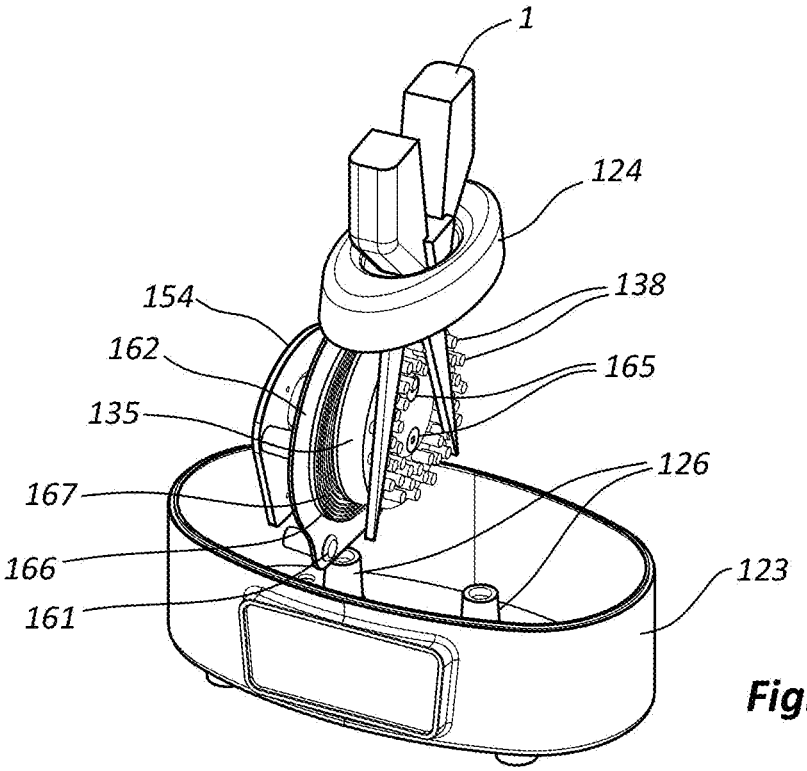

FIG. 16*d* shows some of the remaining components of the epicyclic drive, viewed from the right side after the entire right-side components are omitted. The pruner [1] to be cleaned is inserted into the cap [124] and is contacted by bristles [138] of the scrubber discs of which only the left-side scrubber [135] is shown. The scrubber disc attaches to the planetary shaft by means of two screws [165.]

The epicycle plate [162] is metal and insert or overmolded to include spacer struts [161] which extend away from the center plane of the invention and in this embodiment at least two such struts attach the epicycle plate to the motor faceplate [154.] Both epicyclic mechanisms (of which only the left-side one is shown in this view,) reside above a base [123] or tray component, which includes two hollow struts [126,] one beneath each housing.

Figure 16E:
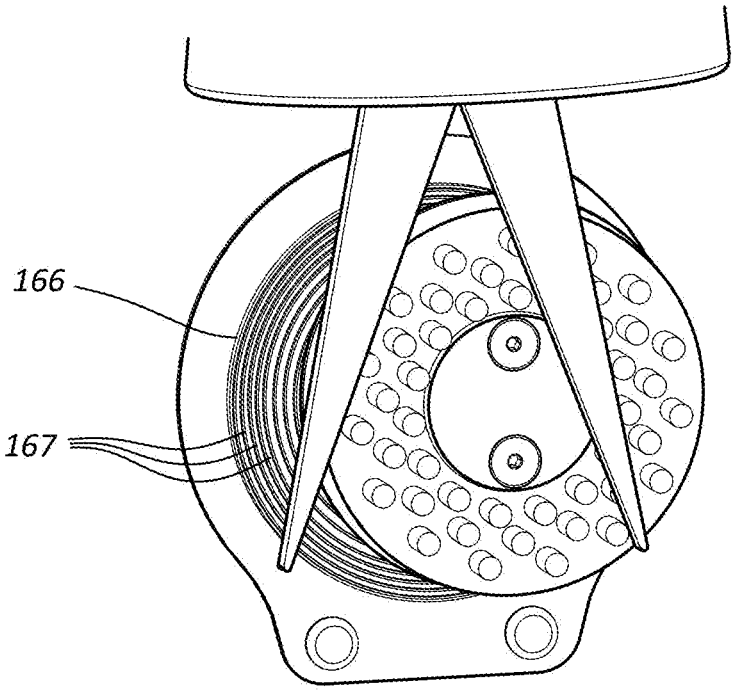
FIG. 16*e* shows the labyrinth seal of the left-side scrubbing mechanism, with its concentric glands.

It is desirable to exclude or prevent cleaning solution or foreign matter from migrating from the central scrubbing chamber or cleaning solution reservoir into the epicyclic drive mechanism, and equally if not more desirable to prevent such cleaning solution or foreign matter from entering into and contaminating the motor or the reduction gearbox between the motor and the scrubber discs. The invention includes a labyrinth seal [166] preferably made of a compressible or elastomeric material, comprising a series of concentric glands [167] in wiping contact with the backside of the scrubber disc. The scrubber disc may include a circular pad made of an elastomeric or compressible material to cooperate with the labyrinth seal glands so as to exclude foreign matter and retard if not prevent the migration of the cleaning fluid towards the planetary shaft of the invention. FIG. 16*e* shows the labyrinth seal [166] of the left-side scrubbing mechanism, with its concentric glands [167.] As measured from the center of rotation of the carrier, the radii of the labyrinth seal and its outermost glands are made smaller than the furthest radial extent of the rim of the scrubber disc, and the radii of at least the smallest gland, if not preferable the smallest two glands, are made smaller than the closest radial extent of the scrubber disc. In a preferred mode, the furthest extent of a scrubber disc passes about ⅛th of an inch (0.125 in) beyond the outer diameter of the largest stationary labyrinth seal gland.

Figure 17:
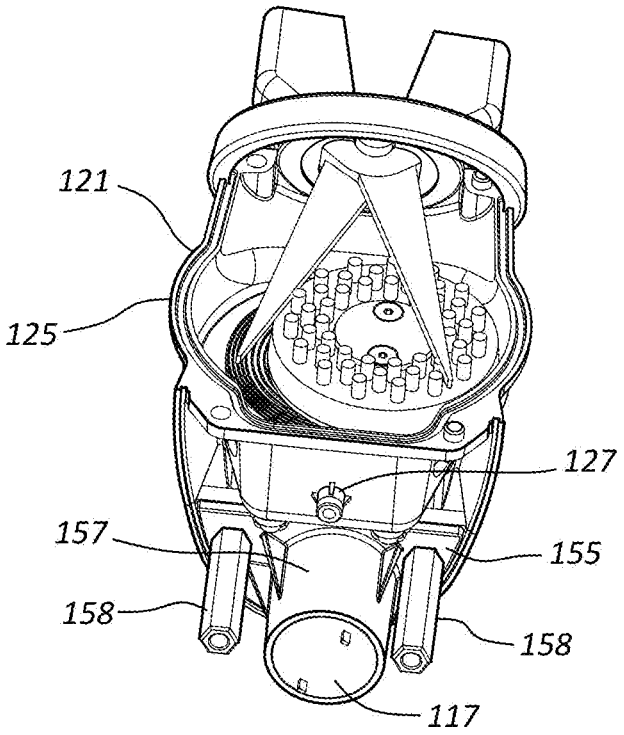
FIG. 17 shows the left side housing containing components of the left-side epicycle scrubbing mechanism from an oblique underside view.

FIG. 17 shows the left side housing [121] containing components of the left-side epicycle scrubbing mechanism from an oblique underside view. The housing contains a groove [125] for receiving a seal such as an o-ring or a gasket for when it is abutted against the right side housing. The motor mount plate [155] rests in the tray or base upon two support struts [158] affixed to it. The motor mount plate in the embodiment shown in this figure is a molded plastic part which also includes a barrel section [115] which closely conforms to and secures the motor [117.] The union of the barrel to the rest of the motor mount plate includes one or more ribs for improved mold flow and structural rigidity. The housing [121] also includes a drain nipple [127] which has an aperture that communicates with the volume, or "gear case" which contains the epicyclic drive mechanism. In the event that cleaning fluids or other contaminants get past the labyrinth seal, they will drain out of the gear case through the drain nipple and out of the pruner cleaning machine.

Figure 18:
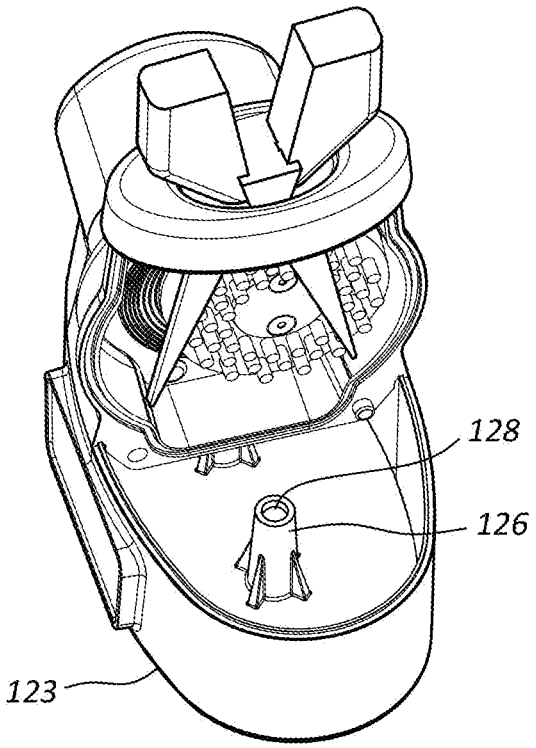
FIG. 18 shows the left-side epicycle scrubbing mechanism in its location above the tray with all other cowlings and right-side components removed.

FIG. 18 shows the left-side epicycle scrubbing mechanism in its location above the tray [123] with all other cowlings and right-side components removed. The tray includes two hollow struts [126] with one disposed under each drain nipple of the left and right gear cases within the pruner cleaning machine. The diameter of the lumen [128] of the hollow strut and the exterior diameter of the drain nipple are closely fitted or a light interference fit, so as to prevent fluid leaving the gear case by its drain nipple from migrating into other areas of the tray.

Since the lumina of the hollow struts lead out of the gear cases of pruner cleaning machine, excess or unusual leakage of cleaning fluid or the appearance of foreign matter onto a work surface where the machine is being used may alert an operator that a labyrinth seal has failed, or that some other mechanical failure or malfunction has allowed the cleaning fluid or contaminants to escape from the cleaning chamber, and that disassembly and inspection of the machine is warranted.

Figure 19:
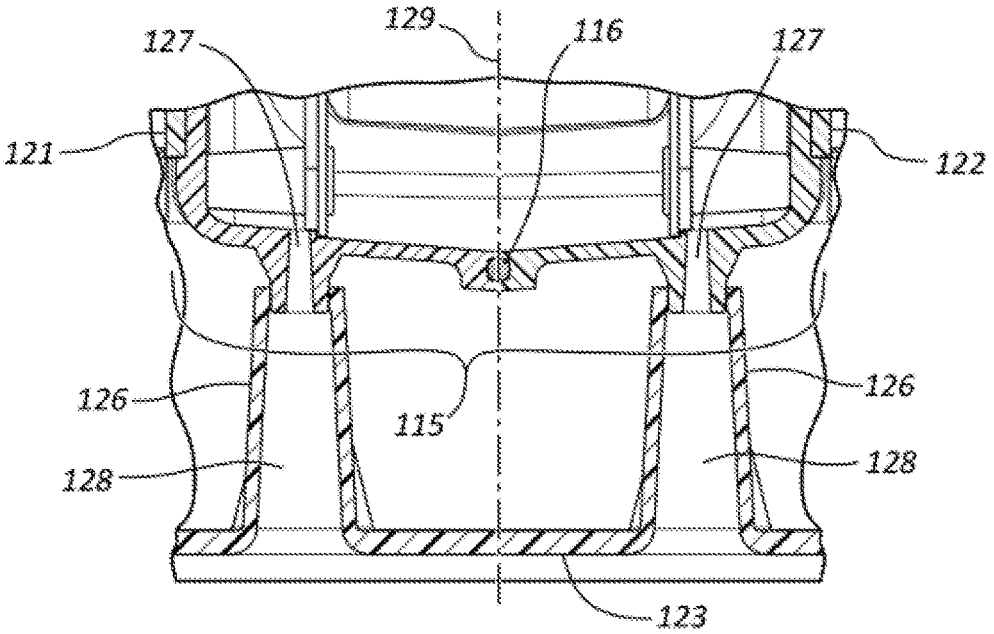
FIG. 19 is a partial view of a cross section of the invention.

FIG. 19 is a partial view of a cross section of the invention. Left housing [121] and right housing [122] are substantially symmetrical and come together to define a center plane [129] and form a reservoir section [115] for cleaning fluid. To prevent the fluid from leaking out of the reservoir, a seal [116] is interposed between the housings. The housings rest upon and are attached to a base [123] or tray. Each housing also defines a gear case containing an epicyclic drive mechanism. Labyrinth seals between the reservoir and the gear cases of the left and right housings resist the entry of cleaning fluid or foreign matter from the reservoir into the gear cases. However, since such seals are rarely foolproof or life-long durable, the gear case section of each housing includes a drain nipple [127] connected to hollow struts [126] in the tray. The drains prevent accumulation of such unwanted fluid or material, and the leakage of such through the lumen [128] of a hollow strut can be noticed on the work surface where the machine is used, Observation of such leakage is an indication that maintenance or inspection of the machine is warranted.

Figure 20:
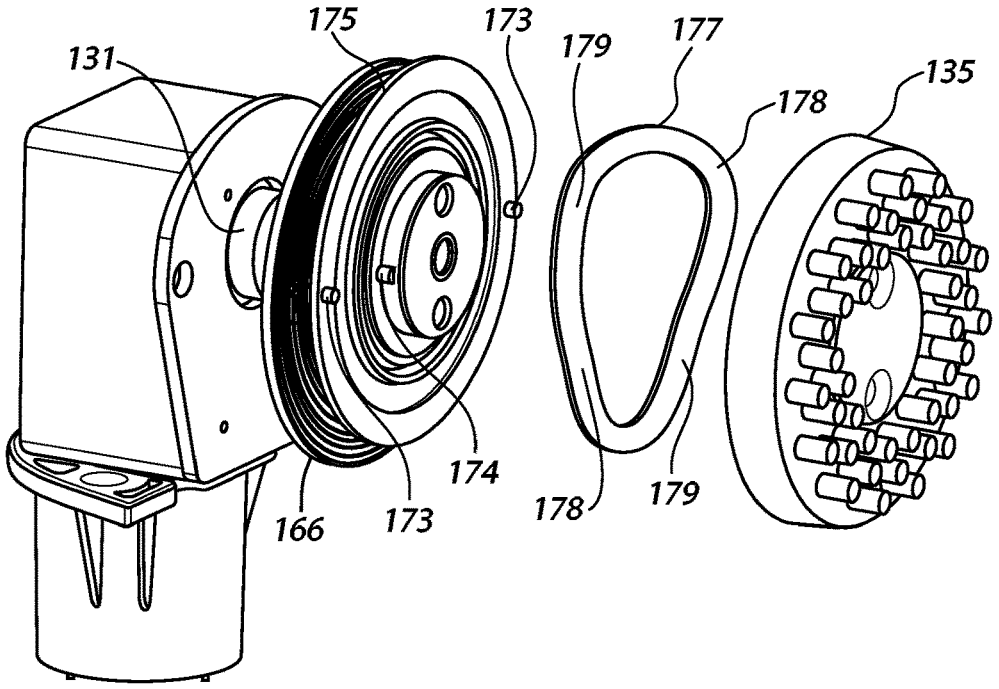
FIG. 20 shows an exploded view of some of the components of the seal interposed between an epicyclic drive and a scrubber disc of the invention.
Figure 21:
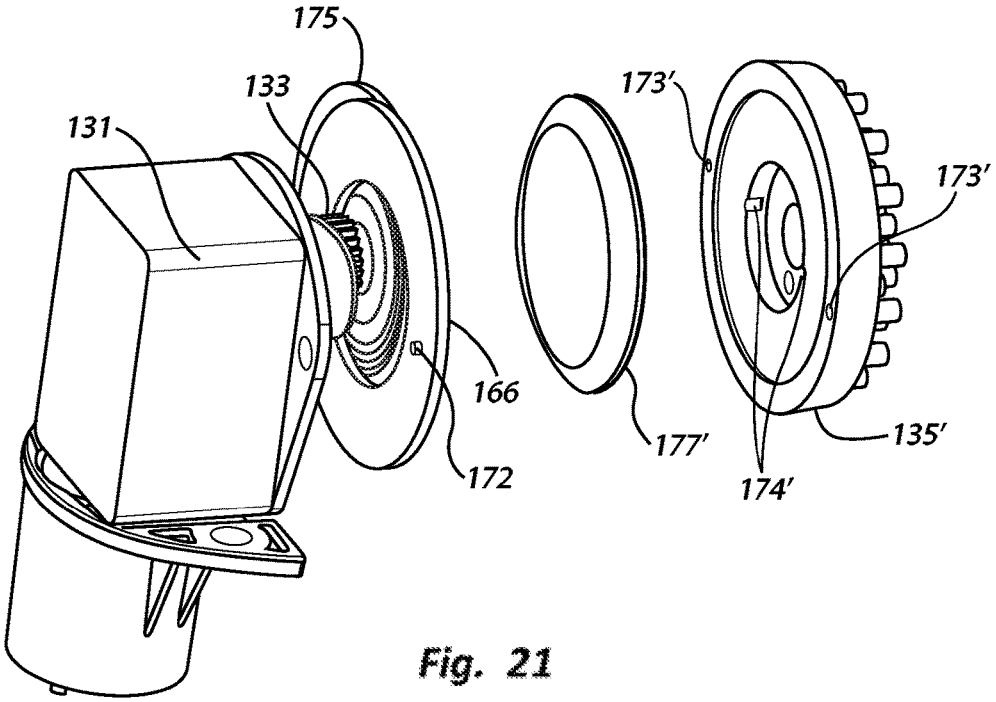
FIG. 21 shows an exploded view of the components shown in FIG. 20, but from another viewpoint.

FIG. 20 shows an exploded view of some of the components of the seal interposed between an epicyclic drive and a scrubber disc [135] of the invention. The epicycle plate is not shown in this figure. A part of the carrier [131] that couples to the output shaft of the drive motor or reduction gearbox is seen behind the motor faceplate. A stationary labyrinth seal [166] affixed to the epicycle plate has concentric glands facing towards the scrubber disc. Another, inner seal [175] rotates with the scrubber disc and has a radial array of projections or studs [173] for rotational coupling with the scrubber disc while allowing axial extension. Another set of projections [174] on the planetary shaft engages with a complementary pocket on the scrubber disc to assist with positive rotational coupling of the planetary shaft and the scrubber disc. The complementary feature is seen in FIG. 21. A wave spring [177] is interposed between the scrubber disc and the inner seal. The wave spring has bulged sections [178] which extend axially toward the scrubber disc and other, oppositely bulged sections [179] that extend axially toward the labyrinth seal. Either the inner seal or the scrubbing disc or both of these parts can have an annular channel to contain the wave spring when assembled.

Assembling the inner seal onto the scrubber disc axially compresses the wavy spring and generates an axial engagement force which presses an annular surface of the inner seal against the concentric glands and grooves of the labyrinth seal. Ideally the contact pressure is uniform and constant over the contact area in motion between the two seal faces. The axial compliance of the inner seal also compensates for angular & radial misalignments accumulated during assembly.

As an example, with the carrier rotating counterclockwise (CCW) while driving the scrubber disc clockwise (CW,) the grooves on the labyrinth seal generate viscous shear in a radially outward wiping direction, which tends to wipe or 'pump' foreign matter towards the outermost grooves of the labyrinth seal and towards the outer rim of the inner seal. The seal mechanism is thus self-cleaning.

Another embodiment within the scope of the invention uses an inner seal which itself includes concentric grooves similar to the concentric glands of a labyrinth seal. The mechanism described here drives the viscous side of the 'pump,' which is the leading edge of the interface between the two sets of abutted seal features, where the inner seal is imparting radially outward shear to material accumulated on the labyrinth seal. Because of the epicycle's offset between the center of rotation of its power input [130 in FIG. 13] and the center of rotation of the planetary shaft, neither the orientation nor the direction of movement of glands or grooves on the inner seal are ever concentric with or tangent to the glands or concentric features of the labyrinth seal, where they are in contact. This condition prevents inner seal features from interdigitating with the labyrinth seal features, which can cause damage to the elastomeric materials or cause excessive and unnecessary wear of these components.

FIG. 21 shows an exploded view of the components shown in FIG. 20, but from another viewpoint. The carrier [131] and a toothed wheel [133] for the epicyclic driver are seen here. The labyrinth seal [166] has at least one or a radial array of projections [172] which insert into the epicycle plate (not shown.) The inner seal [175] rotates with the planetary shaft and the scrubber disc [135.] The scrubber disc has receiving apertures [173'] to receive the projections [173 in FIG. 20] of the inner seal to allow axial excursion of the inner seal with respect to the scrubber disc, and the scrubber disc also includes complementary receiving apertures [174'] which receive projections [174 in FIG. 20] on the planetary shaft for positive rotational coupling and power transfer from the motor drive through to the scrubber disc. Instead of a wavy spring, a conical or Bellville spring [177'] can also be used to provide axial extension force from the scrubber disc to the inner seal. An array of smaller helical springs can also be used to provide axial extension force.

Thus the pruner cleaning machine includes a labyrinth seal, an axially extendable seal coupled to the scrubber disc for coaxial rotation with the scrubber disc, and an axial spring disposed between that axially extendable seal and the scrubber disc.

It is also within the scope of the invention that the projections and pockets are reversed on their respective components while providing their equivalent effects, thus the scrubber disc can have projections which engage with complementary apertures on the planetary shaft and the inner seal, and the labyrinth seal can have apertures which seat onto projections on the epicycle plate. Similarly, locking features of the annular gear overmolding and the epicycle plate can be reversed to equivalent effect. Also, all descriptions of the left-side components in these figures apply to equivalent machinery and structures in the right side of the machine.

Figure 22:
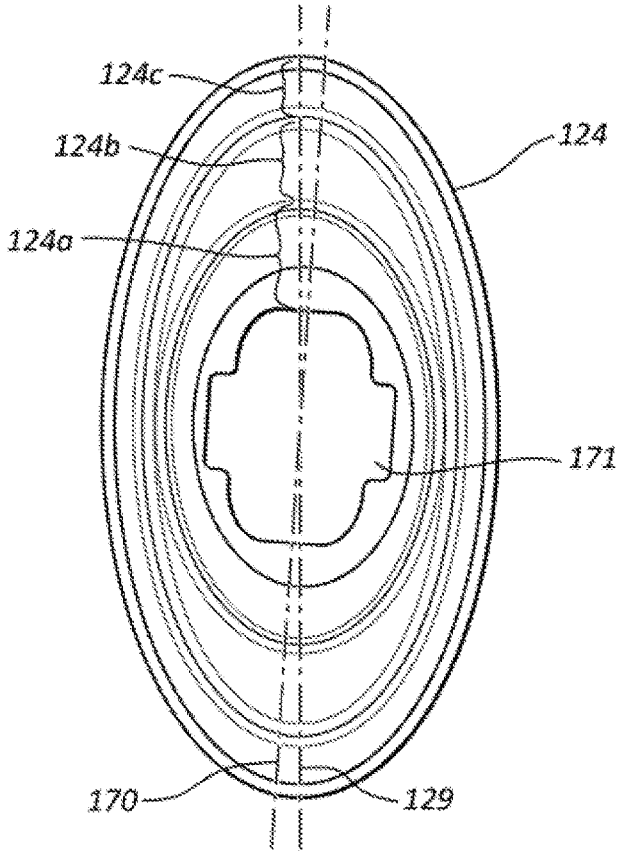
FIG. 22 is a top view of a cap in accordance with the invention.

FIG. 22 is a top view of a cap [124] of the invention. The cap has an aperture [171] in its center and is preferably made of a rubbery, flexible, compressible, or elastomeric material that softly orients the scissors at an angular offset from the center plane [129] defined by the conjoined left and right housings. The pruner receiving aperture orients the center plane [170] of an inserted pruner and its blade surfaces at an angle from the machine center plane [129] of between 1° and 40° inclusive, and a best mode operation occurs between 6° and 15°, where the restoring force of the cap softly opposes and applies pressure for the blades to engage with the moving mass of bristles or scrubbing surfaces of the scrubber discs.

In a typical embodiment the cap will be made entirely of an elastomeric material and the contour of the aperture will closely conform to the pruners to be inserted therein and cleaned. However, since many different makes and models of pruners exist, a set of caps may be manufactured having a relatively firm durometer in its elliptical regions {124*a*] and [124*c*,] while the intervening elliptical region [124*b*] is a flexible, rubbery, or elastomeric diaphragm region. According this kind of embodiment, different caps can be made having different center sections with an aperture customized to each make and model of pruners to be cleaned. A worker can then sort the various pruners by make, and install the appropriate cap for a first set, clean all of those pruners, and then exchange the cap for one adapted for cleaning the next set, and so on until all the various pruners are cleaned and returned to service.

Also, in an additional embodiment in accordance with the invention, although the pruner cleaning machine is described having two motors, it is within the scope of the invention to provide only one motor and to include appropriate power train and rotary power transmission components such as shafts, gears sprockets or belts and the like, so that both epicyclic drives and their scrubber brushes are effectively powered by the single motor.

While certain features and aspects have been described with respect to exemplary embodiments, one skilled in the art will recognize that numerous modifications are possible. Also, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems. Hence, while various embodiments are described with or without certain features for ease of description and to illustrate exemplary aspects of those embodiments, the various components and/or features described herein with respect to a particular embodiment can be substituted, added, and/or subtracted from among other described embodiments, unless the context dictates otherwise. Consequently and in summary, although many exemplary embodiments are described above, it will be appreciated that the invention is intended to cover all modifications and equivalents within the scope of the following claims.

What is claimed is:

1. A pruner cleaning machine, comprising a cap having a pruner receiving aperture, a reservoir beneath said cap, left and right housings conjoined to define a center plane, whereby said pruner receiving aperture orients a blade surface of a pruner received therein at an angle between 1° and 40° inclusive relative to said center plane, said reservoir being formed between said left and right housings, a seal disposed between said left and right housings where said reservoir is formed, a movable cleaning disc coupled to a rotatable planetary shaft such that at least a point on a perimeter of said cleaning disc enters into said reservoir, and a motor and a power switch therefor, said motor operably coupled to a carrier and said planetary shaft coupled to said carrier.

2. The pruner cleaning machine of claim 1, wherein a point on said perimeter of said cleaning disc moves in a roulette path selected from the set of roulette paths consisting of an ellipse, a hypocycloid, an epicycloid, a hypercycloid, a hypotrochoid, an epitrochoid, a limacon, a cardioid, and a nephroid.

3. The pruner cleaning machine of claim 1, further comprising torque-limiting means operably coupled between said motor and said cleaning disc.

4. The pruner cleaning machine of claim 1, further comprising a reduction gear operably coupled between said motor and said cleaning disc.

5. The pruner cleaning machine of claim 1, further comprising a toothed gear mounted on said planetary shaft, said planetary shaft rotatably coupled to said carrier, and said toothed gear meshed to a sun gear.

6. The pruner cleaning machine of claim 1, further comprising a toothed gear mounted on said planetary shaft, said planetary shaft rotatably coupled to said carrier, and said toothed gear meshed to an annular gear.

7. The pruner cleaning machine of claim 1, further comprising a roller mounted on said planetary shaft, said planetary shaft rotatably coupled to said carrier, and said roller in contact with a cylindrical surface.

8. The pruner cleaning machine of claim 1, wherein said motor is a first motor disposed within said left housing, and a second motor is disposed within said right housing.

9. The pruner cleaning machine of claim 1, wherein said cleaning disc is a first cleaning disc disposed within said left housing, and a second cleaning disc is disposed within said right housing.

10. The pruner cleaning machine of claim 1, wherein said cap further comprises an elastomeric material.

11. The pruner cleaning machine of claim 1, wherein said power switch is configured to energize said motor after a pruner is received into said pruner receiving aperture.

12. A pruner cleaning machine comprising a reservoir, a motor operable by a switch, a cleaning disc further comprising a labyrinth seal and an axially extendable seal coupled thereto for coaxial rotation therewith, an axial spring disposed between said axially extendable seal and said cleaning disc, said cleaning disc operably coupled to said motor through a planetary transmission, such that a point on a rim of said cleaning disc enters said reservoir and said point moves in a roulette path when said motor is operating.

13. The pruner cleaning machine of claim 12, wherein said roulette path is selected from the set of roulette paths consisting of an ellipse, a hypocycloid, an epicycloid, a hypercycloid, a hypotrochoid, an epitrochoid, a limacon, a cardioid, and a nephroid.

14. The pruner cleaning machine of claim 12, wherein said switch is a proximity switch.

15. The pruner cleaning machine of claim 12, wherein said switch resides within a housing and is configured to energize said motor after a pruner is received into said reservoir.

16. The pruner cleaning machine of claim 15, wherein said motor is energized after a predetermined delay following insertion of a pruner into said aperture has elapsed.

17. The pruner cleaning machine of claim 15, further comprising a timing circuit whereby said motor is energized after a predetermined delay following insertion of a pruner into said aperture has elapsed.

18. The pruner cleaning machine of claim 15, further comprising a timing circuit whereby said motor is energized for a predetermined duration following insertion of a pruner into said aperture, and thereafter said timing circuit de-energizes said motor.

19. The pruner cleaning machine of claim 18, further comprising a reset circuit whereby said de-energized motor remains de-energized until said inserted pruner is at least partially extracted from said aperture.

* * * * *